US012405042B2

(12) United States Patent
Ma

(10) Patent No.: US 12,405,042 B2
(45) **Date of Patent: *Sep. 2, 2025**

(54) SYSTEM WITH LEAK DETECTION FOR DETECTING REFRIGERANT LEAK

(71) Applicant: Goodman Manufacturing Company, L.P., Waller, TX (US)

(72) Inventor: Zidu Ma, Cypress, TX (US)

(73) Assignee: Goodman Manufacturing Company, L.P., Waller, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/745,246

(22) Filed: Jun. 17, 2024

(65) Prior Publication Data

US 2024/0337423 A1 Oct. 10, 2024

Related U.S. Application Data

(63) Continuation of application No. 18/058,398, filed on Nov. 23, 2022, now Pat. No. 12,013,163.

(60) Provisional application No. 63/266,183, filed on Dec. 30, 2021.

(51) Int. Cl.

| | |
|---|---|
| ***F24F 11/36*** | (2018.01) |
| ***F25B 49/00*** | (2006.01) |
| ***F25B 49/02*** | (2006.01) |

(52) U.S. Cl.
CPC ..... *F25B 49/022* (2013.01); *F24F 11/36* (2018.01); *F25B 49/005* (2013.01); *F25B 2500/222* (2013.01)

(58) Field of Classification Search
CPC ..... F24F 11/36; F25B 49/022; F25B 49/005; F25B 2500/222
See application file for complete search history.

(56) References Cited

U.S. PATENT DOCUMENTS

2019/0170602 A1* 6/2019 Gupte ..... F25B 49/005
2020/0056799 A1* 2/2020 Tomoigawa ..... F24F 13/08

* cited by examiner

*Primary Examiner* — Jonathan Bradford
(74) *Attorney, Agent, or Firm* — K&L Gates LLP

(57) ABSTRACT

A method of detecting and mitigating refrigerant leaks is used in a heating, ventilation, and air conditioning (HVAC) system. The HVAC system includes a leak detection system for detecting a leak of the refrigerant from the refrigerant circuit. The leak detection system includes a collection chamber locatable proximate a component of the HVAC system. The leak detection system also includes a sensor assembly including an enclosure comprising a sensor and a fan. The leak detection system also includes a flowline connecting the collection chamber with the sensor assembly such that the sensor assembly may be located away from the collection chamber and the component. The fan is operable to induce fluid flow from the collection chamber into the sensor assembly and the sensor is operable to analyze the fluid flow and detect a leak of the refrigerant from the component.

20 Claims, 4 Drawing Sheets

SYSTEM WITH LEAK DETECTION FOR DETECTING REFRIGERANT LEAK

BACKGROUND

This section is intended to introduce the reader to various aspects of the art that may be related to various aspects of the presently described embodiments—to help facilitate a better understanding of various aspects of the present embodiments. Accordingly, it should be understood that these statements are to be read in this light, and not as admissions of prior art.

In general, heating, ventilation, and air-conditioning ("HVAC") systems circulate an indoor space's air over low-temperature (for cooling) or high-temperature (for heating) sources, thereby adjusting an indoor space's air temperature and humidity. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop circuit of tubing that uses compressors and other flow-control devices to manipulate the refrigerant's flow and pressure, causing the refrigerant to cycle between the liquid and gas phases. Generally, these phase transitions occur within the HVAC's heat exchangers, which are part of the closed loop and designed to transfer heat between the circulating refrigerant and flowing ambient air or another secondary fluid. As would be expected, the heat exchanger providing heating or cooling to the climate-controlled space or structure is described as being "indoor," and the heat exchanger transferring heat with the surrounding outdoor environment is described as being "outdoor."

Restrictions on the use of certain refrigerants in HVAC and refrigeration systems has accelerated the effort of adapting moderate to low Global Warming Potential (GWP) refrigerants such as mildly flammable (A2L) refrigerants as the replacement of high GWP refrigerants. For example, refrigerant R410A with a GWP of 2088 may be replaced with refrigerant R32 with a GWP of 677. Because moderate to low GWP refrigerants may be mildly flammable, new safety standards have been developed to guide the use of mildly flammable refrigerants. These standards require a risk mitigation system to be installed in heating, ventilation, and air condition and refrigeration (HVAC&R) equipment that uses sensors to detect refrigerant leaks. However, identifying low cost and reliable refrigerant sensor technologies has been a challenging issue.

The current widely acceptable mitigation solution is to use a refrigerant sensor placed near the indoor heat exchanger (HX) coils inside an air handling unit (AHU), or the inside unit of a HVAC system. This exposes the sensor to high temperature (e.g., furnace discharge), high humidity (saturated air), and high air velocity (air flow around indoor coils). The existing sensor technologies have fallen short of guaranteed performances under the conditions. Direct detection of a refrigerant gas, especially certain flammable refrigerant gases, can be unreliable. Certain flammable refrigerant gases are more difficult to predictably and accurately detect with sensors. Further, many conventional sensors may have detection limits that are undesirably high for a specific flammable refrigerant. If the detection limit is too high, there is a risk that the flammable refrigerant may leak from the sealed system and accumulate to a concentration above its lower flammability limit. Unfortunately, the sensitivity of most sensors varies depending upon the refrigerant type and is often not completely adequate. Moreover, sensor selectivity suffers from either being over-selective or under-selective, where "selectivity" as used herein refers to the ability of a sensor to detect a specific analyte of interest at low detection limits without being triggered by other innocuous compounds to indicate a false positive. For example, some sensors exhibit a false positive alarm in the presence of perfume or cologne. Conversely, some gases, in order to be adequately detected at appropriate detection limits, require a very specialized sensor, which adds technical complexity and cost that will hinder its use for the average consumer. Thus, the current and new LGWP flammable refrigerants are difficult to reliably and accurately detect at the detection limits required with the current sensing systems.

Also, making a mitigation system based on existing sensor technologies function in these conditions would require sophisticated packing enclosures to be able to function in the harsh environment with acceptable reliability. This would result in high cost systems. In addition, due to complex configurations in air handling unit designs, multiple sensors may be necessary in some applications. All of these result in a significant cost burden on manufacturers in an already price-competitive and cost-sensitive industry.

There remains a need to develop a sensor system for leak detection that is both highly sensitive with low detection limits, has adequate selectivity, is accurate in detecting the flammable refrigerant, robust and highly reliable, but which is also low cost. Furthermore, it would be desirable to have a universal leak detection system compatible with multiple different refrigerants. Such a system desirably has little dependence on the refrigerant type, so that multiple flammable LGWP refrigerant gases may be detected by a single leak detection system.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The following description relates to moderate-to-low global warming potential (GWP) value refrigerant leak detection and, more particularly, to a controllable moderate-to-low GWP value refrigerant leak detector and a method of operating the same.

The present disclosure relates to a heating, ventilation, and air conditioning (HVAC) system, and more particularly a method of detecting and mitigating refrigerant leaks in an HVAC system. While an HVAC system is discussed, it should also be appreciated that the concepts are applicable to refrigeration systems as well. The HVAC system includes a compressor, an "outdoor" heat exchanger, an expansion device, and an "indoor" heat exchanger connected as components that are part of a refrigerant circuit for the refrigerant. The HVAC system also includes a leak detection system for detecting a leak of the refrigerant from the refrigerant circuit. The leak detection system includes a collection chamber locatable proximate one of the components of the refrigerant circuit where the collection chamber includes ports. The leak detection system also includes a sensor assembly including an enclosure comprising an inlet, a fluid flow path, an outlet, a sensor located in the fluid flow path and a fan located in the fluid flow path. The leak detection system also includes a flowline connecting the collection chamber with the sensor assembly such that the sensor assembly may be located away from the collection chamber and the component. The fan is operable to induce fluid flow from the collection chamber into the sensor assembly and the sensor is operable to analyze the fluid flow and detect a leak of the refrigerant from the component. In this manner, the sensor can be located remotely from high temperature, high humidity, and high air velocity areas of the HVAC system and the sensor may therefore need not be as robust to withstand such environments.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

The present disclosure relates to a heating, ventilation, and air conditioning (HVAC) system, and more particularly a method of detecting and mitigating refrigerant leaks in an HVAC system. While an HVAC system is discussed, it should also be appreciated that the concepts are applicable to refrigeration systems as well.

The HVAC system includes a compressor, an "outdoor" heat exchanger, an expansion device, and an "indoor" heat exchanger connected as components that are part of a refrigerant circuit for the refrigerant. The HVAC system also includes a leak detection system for detecting a leak of the refrigerant from the refrigerant circuit. The leak detection system includes a collection chamber locatable proximate one of the components of the refrigerant circuit where the collection chamber includes ports. The leak detection system also includes a sensor assembly including an enclosure comprising an inlet, a fluid flow path, an outlet, a sensor located in the fluid flow path and a fan located in the fluid flow path. The leak detection system also includes a flowline connecting the collection chamber with the sensor assembly such that the sensor assembly may be located away from the collection chamber and the component. The fan is operable to induce fluid flow from the collection chamber into the sensor assembly and the sensor is operable to analyze the fluid flow and detect a leak of the refrigerant from the component. In this manner, the sensor can be located remotely from high temperature, high humidity, and high air velocity areas of the HVAC system and the sensor may therefore need not be as robust to withstand such environments.

Figure 1:
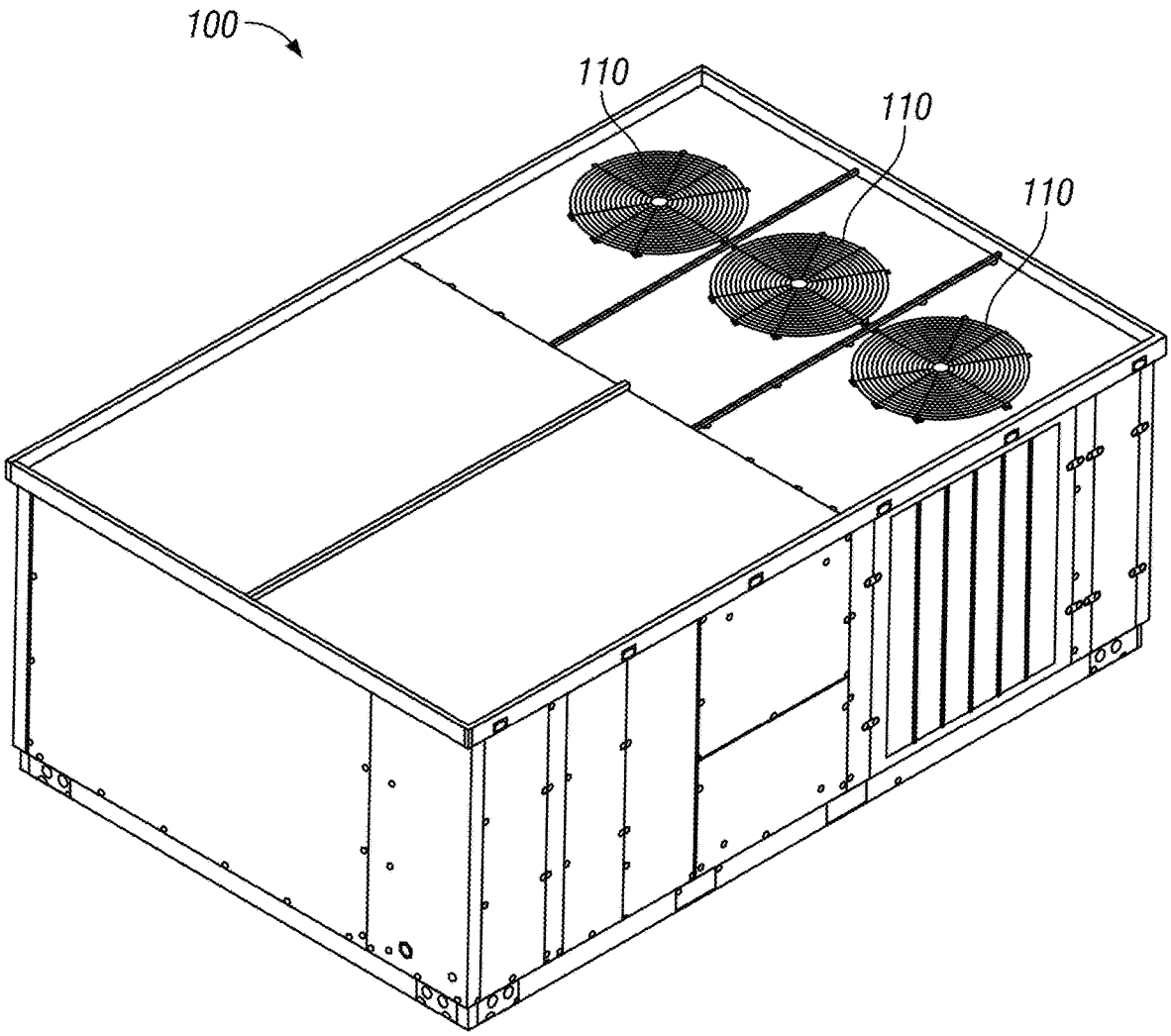
FIGS. 1, 2A, and 2B are isometric and partial isometric views of a heating, ventilation, and air conditioning (HVAC) system with a leak detection system in accordance with one or more embodiments.
Figure 2A:
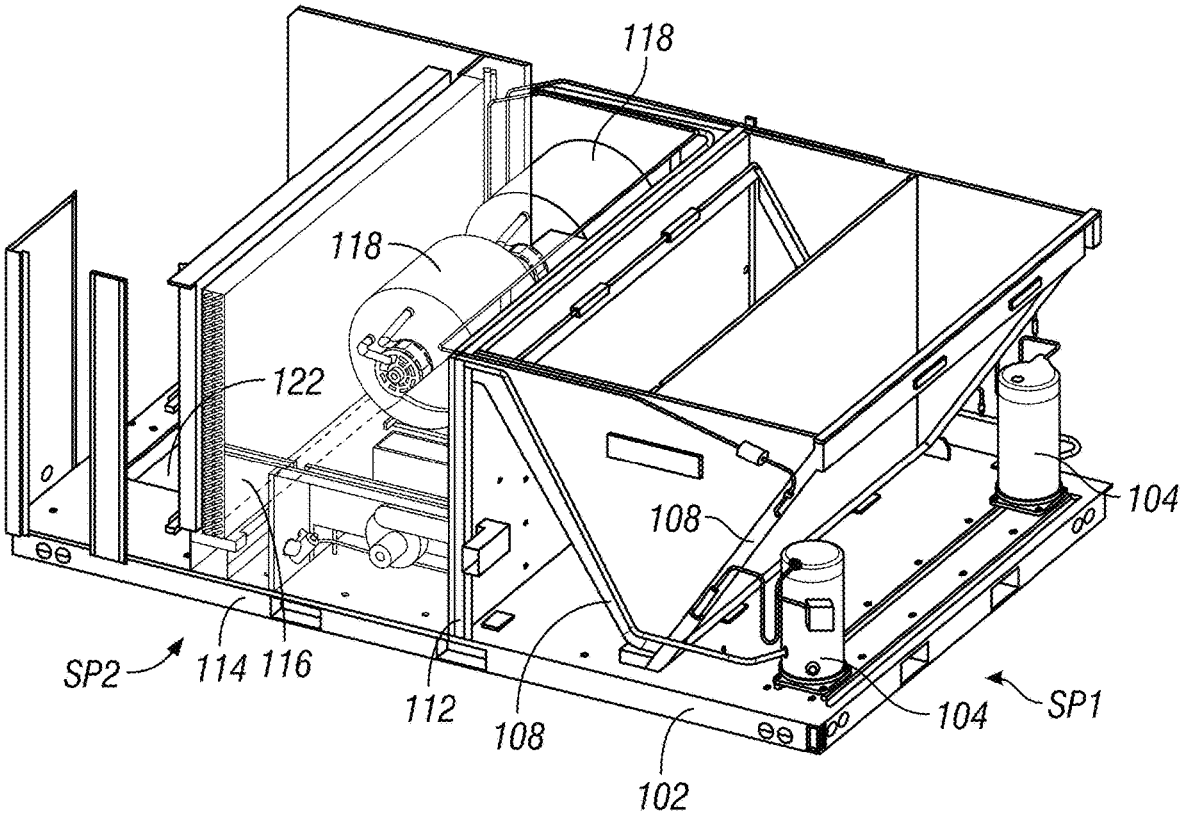
Figure 2B:
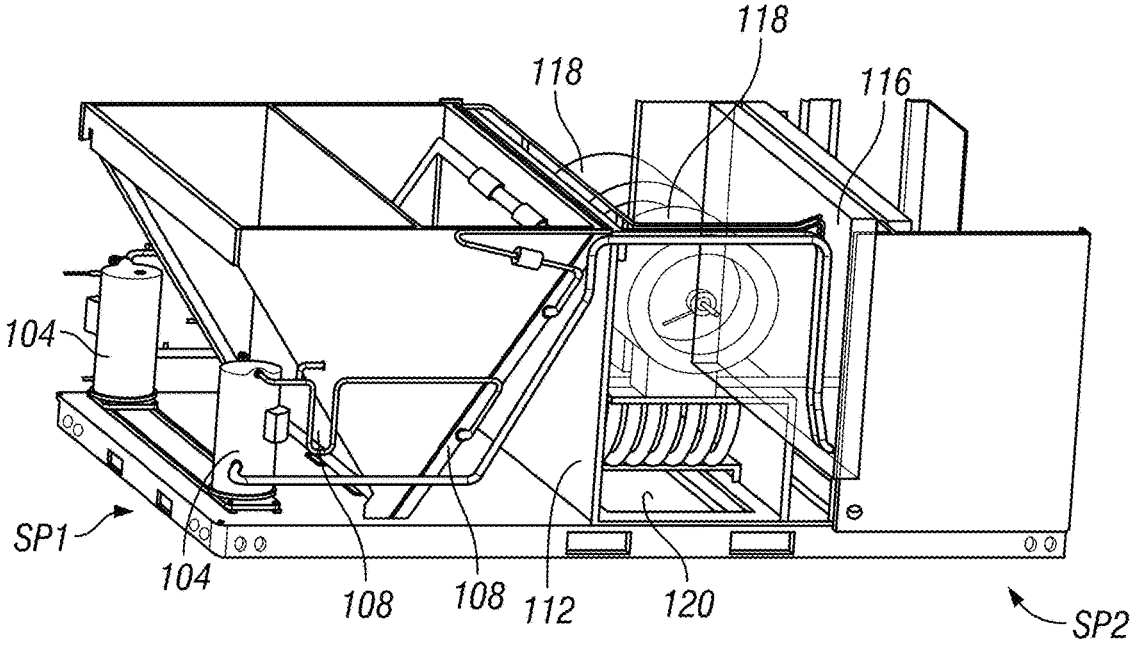

Turning now the figures, FIGS. 1, 2A, and 2B are isometric and partial isometric views of an HVAC system 100 according to at least one embodiment seen from obliquely above the HVAC system 100. Although not shown in each of the drawings, it should be appreciated that the HVAC system 100 in FIGS. 2A and 2B includes additional components such as panel covers for covering and protecting the equipment of the HVAC system 100. The example HVAC system 100HVAC system 100 shown is a so-called "light" commercial packaged rooftop unit and shall be described in terms of a cooling operation, although it should be appreciated that the HVAC system 100 could also be a heat pump and used for heating. Additionally, the HVAC system 100 may also represent residential packaged, residential split, light commercial split, or commercial applied applications as well as refrigeration system applications. The HVAC system 100 may be a variable refrigerant flow system with variable speed outdoor fans 110. The HVAC system 100 includes both an "outdoor" section SP1 and an "indoor" section SP2 mounted on a common frame 102.

The outdoor section SP1 includes one or more compressors 104. As noted above, the outdoor section SP1 may also include other HVAC system components not shown, such accumulators, receivers, charge compensators, flow control devices, air movers, pumps, and filter driers. The outdoor section SP1 includes three outdoor fans 110 that move air across the outdoor HXs 108 and to the outside of the HVAC system 100. The outdoor fans 110 may be any suitable type of fan, for example, a propeller fan. Although FIG. 1 shows three outdoor fans 110, there may be more or fewer outdoor fans 110 as needed based on the particular HVAC system 100.

The outdoor section SP1 also includes two outdoor HXs 108. Although not required, the outdoors HXs 108 angle toward each other to be arranged in a V-shape. The outdoor HXs 108 are also shown as planar. However, it should be appreciated that the outdoor HXs 108 may also be formed (bent in an arc or other shape). The outdoor HXs 108 may include a plurality of heat-transfer tubes (not shown) through which a refrigerant flows and a plurality of heat-transfer fins (not shown) in which air flows between gaps thereof. The plurality of heat-transfer tubes may be arranged in an up-down direction (hereunder may be referred to as "row direction"), and each heat-transfer tube may extend in a direction substantially orthogonal to the up-down direction (in a substantially horizontal direction). At an end portion of the outdoor HXs 108, for example, the heat-transfer tubes are connected to each other by being bent into a U-shape or by using a U-shaped return bends so that the flow of a refrigerant from a certain column to another column and/or a certain row to another row is turned back. The plurality of heat-transfer fins that extend so as to be oriented in the up-down direction are arranged side by side in a direction in which the heat-transfer tubes extend with a predetermined interval between the plurality of heat-transfer fins. The plurality of heat-transfer fins and the plurality of heat-transfer tubes are assembled to each other so that each heat-transfer fin extends through the plurality of heat-transfer tubes. The plurality of heat-transfer fins are also disposed in a plurality of columns. Although the outdoor HXs are described as a round tube and plate fin HX, other heat exchanger types, such as for instance microchannel HX, are also within the scope of the disclosure. Although FIG. 1 shows two outdoor HXs 108, there may be more or fewer outdoor HXs 108 as needed based on the particular HVAC system 100.

Due to the structure of the outdoor HXs 108, a flow path of outdoor air that enters the outdoor section SP1 passes through the outdoor HXs 108, where the outdoor air exchanges thermal energy with a refrigerant that flows in a refrigerant circuit through the outdoor HXs 108. After the thermal energy exchange in the outdoor HXs 108, the air is discharged to the outside of the outdoor section SP1 by the outdoor fans 110.

The outdoor section SP1 is separated from the indoor section SP2 by a partition plate 112. Outdoor air flows to the outdoor section SP1 and indoor air from the structure being cooled or heated flows to the indoor section SP2. In an ordinary state, the indoor air and the outdoor air do not mix and do not communicate with each other within or via the HVAC system 100. It is noted that there optionally exist airside economizers that allow mixing indoor and outdoor air, however such economizers are not reviewed in relation to this discussion. Although not shown, the outdoor section SP1 includes an expansion device for expansion of the refrigerant from a high pressure to low pressure, for example, a thermostatic expansion valve (TXV) or electronic expansion valve (EXV). The expansion device may alternatively be located in the indoor section SP2.

The indoor section SP2 also includes an indoor HX 116 and indoor blowers 118, which may be, for example, a centrifugal fan. The indoor HX 116 may also include a plurality of heat-transfer tubes through which the refrigerant flows, and a plurality of heat-transfer fins in which air flows between gaps thereof. The plurality of heat-transfer tubes may be arranged in an up-down direction (row direction), and each heat-transfer tube may extend in a direction substantially orthogonal to the up-down direction (in the second embodiment, in a left-right direction). At an end portion of the indoor HX 116, for example, the heat-transfer tubes are connected to each other by being bent into a U-shape or by using a U-shaped return bends so that the flow of a refrigerant from a certain column to another column and/or a certain row to another row is turned back. The plurality of heat-transfer fins and the plurality of heat-transfer tubes may be assembled so that each heat-transfer fin extends through the plurality of heat-transfer tubes. Although the indoor HX 116 is described as a round tube and plate fin HX, other heat exchanger types, such as for instance microchannel HX, are also within the scope of the disclosure.

The indoor HX 116 divides the indoor section SP2 into a space on an upstream side with respect to the indoor HX 116 and a space on a downstream side with respect to the indoor HX 116. Air that flows to the downstream side from the upstream side with respect to the indoor HX 116 passes through the indoor HX 116. The blowers 118 is disposed in the space on the downstream side with respect to the indoor HX 116 and generates an airflow that passes through the indoor HX 116. A supply air duct 120 is connected to the indoor section SP2 through a bottom plate 114 in the bottom of the HVAC system 100 (note that the side air supply and discharge are also feasible). Alternatively, horizontal, instead of downward, supply and return air ducts can be provided, and the down-shot air duct configurations are also within the scope of the disclosure. The blowers 118 is disposed above the supply air duct 120 for providing supply air to the indoor space being conditioned. The HVAC system 100 may draw in ambient air to be conditioned. The bottom plate 114 may also include a return air duct 122 that provides return air from the indoor space being conditioned to either flow through the indoor HX 116 and the blowers 118 again or be expelled to the outside environment.

The HVAC system 100 also includes a refrigerant circuit that includes the indoor HX 116 and the outdoor HXs 108 and in which a refrigerant circulates between the indoor HX 116 and the outdoor HXs 108. In the refrigerant circuit, the refrigerant goes through a vapor compression refrigeration cycle and thermal energy is exchanged at the indoor HX 116 and the outdoor HXs 108 between the refrigerant and the air outside the HXs. The refrigerant circuit includes the compressors 104, the outdoor HXs 108, the expansion device, and the indoor HX 116.

When operating to cool the indoor air, the refrigerant is compressed by the compressor(s) 104 and is sent to the outdoor HXs 108. The refrigerant exchanges thermal energy to outdoor air at the outdoor HXs 108 and is then sent to the expansion device. At the expansion device, the refrigerant expands and its pressure and temperature are reduced. The refrigerant is then sent to the indoor HX 116, where the low temperature, low-pressure refrigerant exchanges thermal energy with the ambient and/or return air. The ambient/return air is cooled by having thermal energy absorbed by the refrigerant in the indoor HX 116 and is supplied to the indoor space being conditioned. The vapor refrigerant after the heat exchange at the indoor HX 116 is then sucked into the compressors 104 to repeat the cycle.

The equipment of the refrigerant circuit, and thus flow of the refrigerant through the circuit may be controlled by a main controller that controls the HVAC system 100. The main controller may also be capable of communicating with a remote controller. A user can send, for example, set values for indoor temperatures of rooms in the indoor space being conditioned to the main controller from the remote controller. For controlling the HVAC system 100, a plurality of temperature sensors for measuring the temperature of a refrigerant at each portion of the refrigerant circuit and/or a pressure sensor that measures the pressure of each portion and a temperature sensor for measuring the air temperature of each location may be provided.

The main controller performs at least on/off control of the compressors 104, on/off control of the outdoor fans 110, and on/off control of the indoor blowers 118. When any or all of the compressors 104, the outdoor fans 110, and the indoor blowers 118 include a motor of a type whose speed is changeable, the main controller may be configured to control the speed of the motor or motors. In this case, the main controller can control the circulation amount of the refrigerant that flows through the refrigerant circuit by changing the operation of the motor of the compressors 104. The main controller can change the flow rate of outdoor air that flows between the heat-transfer fins of the outdoor HXs 108 by changing the speed of the motor of the outdoor fans 110. The main controller can change the flow rate of indoor air that flows between the heat-transfer fins of the indoor HX 116 by changing the speed of the motor of the indoor blowers 118.

The main controller may be realized by, for example, a computer. The computer that constitutes the main controller includes a control calculation device and a storage device. For the control calculation device, a processor such as a CPU or a GPU may be used. The control calculation device reads a program that is stored in the storage device and performs a predetermined image processing operation and a computing processing operation in accordance with the program. Further, the control calculation device writes a calculated result to the storage device and reads information stored in the storage device in accordance with the program. However, the main controller may be formed by using an integrated circuit (IC) that can perform control similar to the control that is performed by using a CPU and a memory. Here, IC includes, for example, LSI (large-scale integrated circuit), ASIC (application-specific integrated circuit), a gate array, and FPGA (field programmable gate array).

Figure 3:
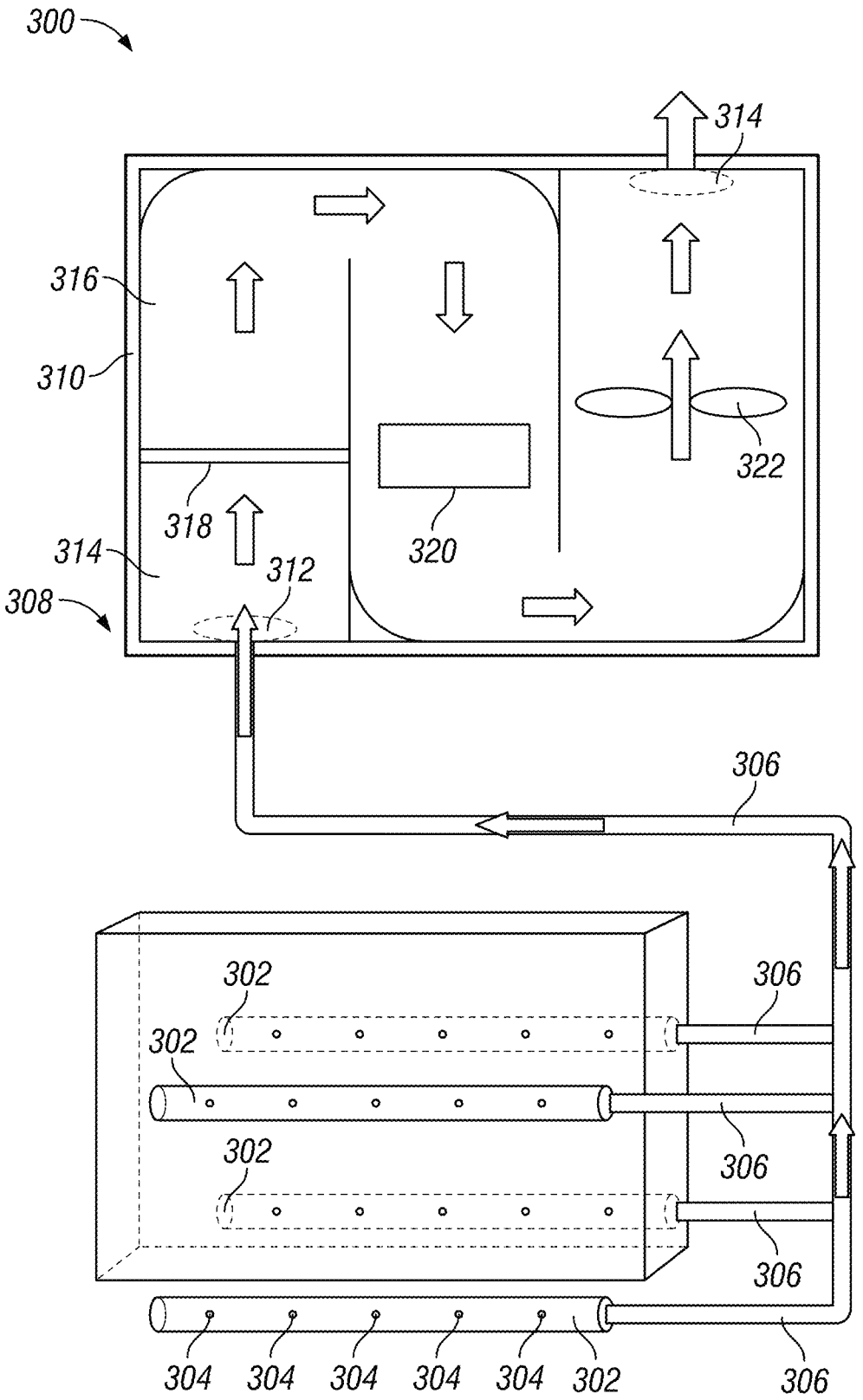
FIG. 3 is a schematic view of a leak detection system for use with an HVAC system in accordance with one or more embodiments.
Figure 4:
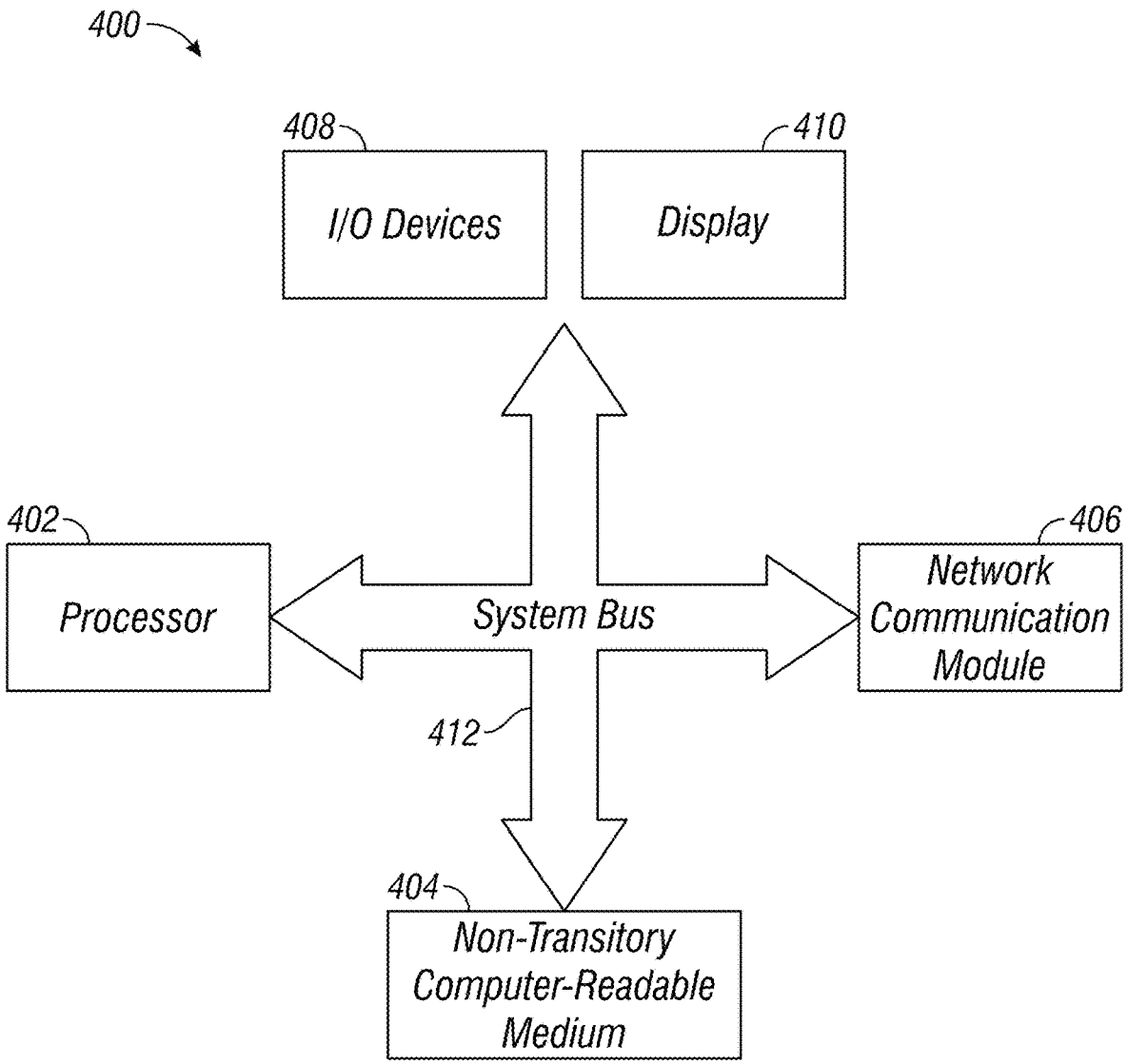
FIG. 4 is a block diagram of a controller, according to one or more embodiments.

As shown schematically in FIG. 3, the HVAC system also includes a leak detection system 300 for detecting a leak of the refrigerant from the refrigerant circuit. The leak detection system 300 includes one or more collection chambers 302 locatable proximate at least one of the components of the refrigeration circuit. In FIG. 3, four collection chambers 302 are arranged proximate the indoor HX 116 for detecting a refrigerant leak from the indoor HX 116. However, it should be appreciated that fewer or more collection chambers 302 may be used. In addition, collection chambers 302 may be arranged proximate any component of the refrigerant circuit, whether on the indoor section or the outside section. As shown in FIG. 3, each collection chamber is a hollow tube. However, the shape, size, and dimensions of the collection chambers 302 may be anything suitable for the location and environment in which the collection chambers 302 are placed. The collection chambers 302 may also be any suitable material, such as a polymer such as polyvinyl chloride (PVC), or metal such as aluminum or steel. Each collection chamber 302 comprises ports 304 that allow fluid, such leaking refrigerant, to enter into the collection chamber 302. As shown, each collection chamber 302 includes five equally-sized and equally-spaced ports 304. However, the ports 304 may be sized and arranged depending on the desired flow characteristics of the fluid entering the collection chambers 302. For example, some of the ports 304 may be larger at one end of the collection chamber 302 to account for suction loss within the collection chamber 302 over the ports 304. Thus, at least two of the ports may be of a different size.

Fluidly connecting the inside of the collection chambers 302 with a sensor assembly 308 (discussed below) are flowlines 306. The flowlines 306 may connect with each collection chamber 302 and communicate with the sensor assembly 308 individually. Alternatively, as shown, the flowlines 306 may be connected in a manifold as shown such that the flowlines 306 combine into a single flowline 306 before connecting with the sensor assembly 308. Further, although shown as connecting with ends of the collection chambers 302, the flowlines 306 may instead connect to any portion of the collection chambers 302, including the other end or an intermediate portion between the ports 304. Still further, the flowlines 306 may be any suitable material and may be either rigid or flexible depending on the operating environment and other factors.

As mentioned, the flowlines 306 fluidly connect the collection chambers 302 with a sensor assembly 308. The sensor assembly 308 includes an enclosure 310 comprising an inlet 312 and an outlet 314, with a fluid flow path 316 therebetween. Located within the fluid flow path 316 are a filter 318, a sensor 320, and a fan 322. There may also be more than one filter 318, sensor 320, or fan 322 in the sensor assembly 308. Further, even though the fluid flow path 316 is shown as tortuous, the fluid flow path 316 may be any configuration as needed for design constraints such as available space.

The fan 322 operates to induce fluid flow from the collection chambers 302, through the flowlines 306, and into the sensor assembly 308. In this manner, the fan 322 is operable to pull in fluid at or near the ports 304 of the collection chambers 302. With the collection chambers 302 properly placed, any leaking refrigerant from the indoor HX 116 is thus pulled into one or more of the collection chambers 302 by the operation of the fan 322. The fluid collected by the collection chambers 302 enters the sensor assembly 308 through the inlet 312. Once inside, the fluid flows into the inlet 312 and through the filter 318, where the fluid is filtered for any debris or other contaminants. The fluid continues along the fluid flow path 316 until the fluid reaches the sensor 320. The sensor 320 analyzes the fluid and is operable to detect any refrigerant in the fluid flow, thus detecting a leak of the refrigerant from the component, such as the indoor HX 116. The fluid continues past the sensor 320 and then flows past the fan 322 and out the sensor assembly 308 though the outlet 314. The fan 322 is operable and the collection chambers 302 and the flowlines 306 are designed such that the fluid flow induced by the fan 322 has enough velocity to reach the sensor 320 quickly enough to be detected by the sensor 320 within ten seconds. It should also be appreciated that the fan 322 may be operable and the collection chambers 302 and the flowlines 306 designed to meet any other industry standards or regulatory requirements in terms of time of detection.

By using one sensor assembly 308 in fluid communication with any potential leaks through the collection chambers 302 and the flowlines 306, the leak detection system 300 is able to be located away from the component being monitored. For example, the sensor assembly 308 may be located out of the indoor section SP2. If the sensor 320 were directly placed at the indoor HX 116 or within the indoor section SP2, the sensor 320 would be exposed to high temperatures (e.g., greater than 155° F. (341 K)), high humidity (~100% RH), high air velocity (e.g., 350 fpm (106 m/s)), and large temperature swings in short amounts of time. Such a robust, reliable and accurate sensor would potentially be cost-prohibitive for some HVAC systems. By being located away from the indoor section SP2, the sensor assembly 308 may use a sensor 320 that does not need to be as robust and therefore may be more cost efficient while still maintaining the accuracy and reliability needed for the leak detection system 300.

FIG. 11 is a block diagram of a controller 400 that can be used to control the blower(s) and the compressor(s) of an HVAC system, such as in the control systems described above. The controller 400 includes at least one processor 402, a non-transitory computer readable medium 404, an optional network communication module 406, optional input/output devices 408, a data storage drive or device, and an optional display 410 all interconnected via a system bus 412. In at least one embodiment, the input/output device 1108 and the display 410 may be combined into a single device, such as a touch-screen display. Software instructions executable by the processor 402 for implementing software instructions stored within the controller 400 in accordance with the illustrative embodiments described herein, may be stored in the non-transitory computer readable medium 404 or some other non-transitory computer-readable medium.

Should a leak of refrigerant be detected by a leak detection system such as the leak detection system described above, the controller 400 is operable to stop operation of the compressor(s) of the HVAC system until such time as the leak dissipates and/or is repaired. Further, the controller 400 may also activate output devices such as audible alarm and a visual alarm when the sensor detects a refrigerant leak. The alarms may be activated on the display 410, for example. The alarms may also be remote from the HVAC system with the controller 400 communicating remotely with the alarms through a network connection.

The controller 400 may be realized by, for example, a computer. The computer that constitutes the controller 400 may include a control calculation device and a storage device. For the control calculation device, a processor such as a CPU or a GPU may be used. The control calculation device reads a program that is stored in the data storage device and performs a predetermined computing processing operation in accordance with the program. Further, the control calculation device writes a calculated result to the storage device and reads information stored in the storage device in accordance with the program. Alternatively, the controller 400 may be formed by using an integrated circuit (IC) that can perform control similar to the control that is performed by using a CPU. Here, IC includes, for example, LSI (large-scale integrated circuit), ASIC (application-specific integrated circuit), a gate array, and FPGA (field programmable gate array).

Although not explicitly shown in FIG. 11, it should be recognized that the controller 400 may be connected to one or more public and/or private networks via appropriate network connections. It will also be recognized that software instructions may also be loaded into the non-transitory computer readable medium 404 from an appropriate storage media or via wired or wireless means.

Certain terms are used throughout the description and claims to refer to particular features or components. As one skilled in the art will appreciate, different persons may refer to the same feature or component by different names. This document does not intend to distinguish between components or features that differ in name but not function.

For the embodiments and examples above, a non-transitory computer readable medium can comprise instructions stored thereon, which, when performed by a machine, cause the machine to perform operations, the operations comprising one or more features similar or identical to features of methods and techniques described above. The physical structures of such instructions may be operated on by one or more processors. A system to implement the described algorithm may also include an electronic apparatus and a communications unit. The system may also include a bus, where the bus provides electrical conductivity among the components of the system. The bus can include an address bus, a data bus, and a control bus, each independently configured. The bus can also use common conductive lines for providing one or more of address, data, or control, the use of which can be regulated by the one or more processors. The bus can be configured such that the components of the system can be distributed. The bus may also be arranged as part of a communication network allowing communication with control sites situated remotely from system.

In various embodiments of the system, peripheral devices such as displays, additional storage memory, and/or other control devices that may operate in conjunction with the one or more processors and/or the memory modules. The peripheral devices can be arranged to operate in conjunction with display unit(s) with instructions stored in the memory module to implement the user interface to manage the display of the anomalies. Such a user interface can be operated in conjunction with the communications unit and the bus. Various components of the system can be integrated such that processing identical to or similar to the processing schemes discussed with respect to various embodiments herein can be performed.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims. For example, certain embodiments disclosed here envisage usage with a powered fan rather than an inducer fan, or no fan at all. Moreover, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

What is claimed is:

1. A heating, ventilation, and air conditioning (HVAC) system for use with a refrigerant, comprising:

a compressor, an outdoor heat exchanger, an expansion device, and an indoor heat exchanger connected as components of a refrigerant circuit for the refrigerant, wherein the indoor heat exchanger locatable in an indoor section and a fluid flow is induced across the indoor heat exchanger in a first direction; and a leak detection system for detecting a leak of the refrigerant from at least one of the components, comprising:

collection chambers locatable proximate more than one of the components, each collection chamber comprising a port through which the fluid flow is drawn;

a sensor assembly comprising an enclosure comprising an inlet, a leak-detection fluid flow path, an outlet, a sensor located in the leak-detection fluid flow path, and a fan located in the leak-detection fluid flow path; and flowlines connecting the collection chambers with the sensor assembly such that the sensor assembly is locatable away from the collection chambers and the components and outside of the indoor section;

wherein the fan is operable to induce flow of the fluid flow into the collection chambers and from the collection chambers into the sensor assembly; and wherein the sensor is operable to analyze the fluid flow from the collection chambers and detect a leak of the refrigerant from at least one of the components.

2. The system of claim 1, further comprising an indoor blower locatable in the indoor section and operable to induce the fluid flow across the indoor heat exchanger.

3. The system of claim 1, further comprising at least one of an audible alarm or visible alarm that activates when the sensor detects the leak.

4. The system of claim 1, further comprising a controller operable to stop operation of the compressor when the sensor detects the leak.

5. The system of claim 1, wherein at least one of the collection chambers comprises more than one port spaced along the collection chamber.

6. The system of claim 1, wherein the fan is operable to induce enough fluid flow from the collection chambers such that the sensor can detect the leak within ten seconds of the refrigerant leaking.

7. The system of claim 1, wherein at least one of the collection chambers is locatable proximate the indoor heat exchanger.

8. The system of claim 1, wherein the flowline is flexible.

9. A method of operating a heating, ventilation, and air conditioning (HVAC) system, comprising:

operating a compressor to circulate a refrigerant through a refrigerant circuit that also includes an outdoor heat exchanger, an expansion device, and an indoor heat exchanger connected as components of the refrigerant circuit, wherein the indoor heat exchanger is located in an indoor section and a fluid flow is induced across the indoor heat exchanger in a first direction;

operating a fan within an enclosure of a sensor assembly to induce flow of the fluid flow into collection chambers through a port in each collection chamber, through flowlines, and into the sensor assembly, wherein the collection chambers are located proximate more than one of the components and the sensor assembly is located away from the collection chambers and the components and outside of the indoor section; and analyzing the fluid flow from the collection chambers with a sensor in the enclosure of the sensor assembly to detect a leak of the refrigerant from at least one of the components.

10. The method of claim 9, further comprising operating a blower in the indoor section to induce the fluid flow across the indoor heat exchanger.

11. The method of claim 9, further comprising activating at least one of an audible alarm or visible alarm when the sensor detects the leak.

12. The method of claim 9, wherein at least one of the collection chambers comprises more than one port spaced along the collection chamber.

13. The method of claim 9, further comprising operating a controller to stop operation of the compressor when the sensor detects the leak.

14. The method of claim 9, wherein operating the fan further comprises inducing enough fluid flow from the collection chambers such that the sensor can detect the leak within ten seconds of the refrigerant leaking.

15. The method of claim 9, further comprising locating at least one of the collection chambers proximate the indoor heat exchanger.

16. A leak detection system for detecting a leak of a refrigerant from a heating, ventilation, and air conditioning (HVAC) system comprising a compressor, an outdoor heat exchanger, an expansion device, and an indoor heat exchanger connected as components of a refrigerant circuit of the HVAC system for the refrigerant, wherein the indoor heat exchanger is locatable in an indoor section and airflow is induced across the indoor heat exchanger in a first direction, the leak detection system comprising:

collection chambers locatable proximate more than one of the components of the refrigerant circuit, each collection chamber comprising a port through which the airflow is drawn;

a sensor assembly comprising an enclosure comprising an inlet, a leak-detection fluid flow path, an outlet, a sensor located in the leak-detection fluid flow path and a fan located in the leak-detection fluid flow path; and flowlines connecting the collection chambers with the sensor assembly such that the sensor assembly is locatable away from the collection chambers and the components and outside of the indoor section;

wherein the fan is operable to induce flow of the fluid flow into the collection chambers and from the collection chambers into the sensor assembly; and wherein the sensor is operable to analyze the fluid flow from the collection chambers to detect a leak of the refrigerant from at least one of the components.

17. The system of claim 16, further comprising at least one of an audible alarm or visible alarm that activate when the sensor detects the leak.

18. The system of claim 16, further comprising a controller operable to stop operation of the compressor when the sensor detects the leak.

19. The system of claim 16, wherein the fan is operable to induce enough fluid flow from the collection chambers such that the sensor can detect the leak within ten seconds of the refrigerant leaking.

20. The system of claim 16, wherein at least one of the collection chambers is locatable proximate the indoor heat exchanger.

* * * * *